US009376626B1

(12) United States Patent
Malone et al.

(10) Patent No.: US 9,376,626 B1
(45) Date of Patent: Jun. 28, 2016

(54) TURBULENT MESOPHASE PITCH PROCESS AND PRODUCTS

(75) Inventors: Donald P. Malone, Grayson, KY (US); Donald M. Lee, Huntington, WV (US)

(73) Assignee: ADVANCED CARBON PRODUCTS, LLC, Hitchins, KY (US)

( * ) Notice: Subject to any disclaimer, the term of this patent is extended or adjusted under 35 U.S.C. 154(b) by 672 days.

(21) Appl. No.: 13/458,434

(22) Filed: Apr. 27, 2012

Related U.S. Application Data

(60) Provisional application No. 61/517,964, filed on Apr. 28, 2011.

(51) Int. Cl.
*C10C 3/02* (2006.01)
*C10C 3/00* (2006.01)

(52) U.S. Cl.
CPC ..... *C10C 3/002* (2013.01); *C10C 3/023* (2013.01); *C10C 3/026* (2013.01)

(58) Field of Classification Search
CPC ..... C10C 3/00; C10C 3/002; C10C 3/02; C10C 3/023; C10C 3/026
USPC ..... 208/39, 40, 44
See application file for complete search history.

(56) References Cited

U.S. PATENT DOCUMENTS

| | | | | |
|---|---|---|---|---|
| 4,184,942 | A | 1/1980 | Angier et al. | |
| 4,208,267 | A | 6/1980 | Diefendorf et al. | |
| 4,209,500 | A | 6/1980 | Chwastiak | |
| 4,663,021 | A * | 5/1987 | Arai et al. | 208/67 |
| 5,238,672 | A | 8/1993 | Sumner et al. | |
| 6,833,012 | B2 | 12/2004 | Rogers | |
| 7,220,348 | B1 | 5/2007 | Malone et al. | |
| 7,318,890 | B1 | 1/2008 | Malone | |
| 7,318,891 | B1 * | 1/2008 | Malone | 208/41 |
| 7,341,656 | B1 | 3/2008 | Malone et al. | |

* cited by examiner

*Primary Examiner* — Renee E Robinson
(74) *Attorney, Agent, or Firm* — Richard D Stone

(57) ABSTRACT

A process for producing mesophase pitch using a long tube reactor is disclosed. An aromatic rich feed, preferably a petroleum pitch having a softening point above 100° C., is preheated to a temperature above its softening point and mixed with a vapor, preferably steam, in a long tubular reactor under intense mixing conditions, preferably fully developed turbulent flow such as mist annular flow, with a residence time at least an order of magnitude less than prior art processes and preferably less than 10 seconds. Preferably the reactor is heated by electric resistance or induction heating or by immersion in a heated fluid or in a fired heater. Mesophase pitch with a high coking value and a surprisingly low quinolone insoluble content is produced. The byproducts of thermal polymerization and thermal dealkylation have less than 50% as much olefin and diene content as compared to similar byproducts from prior art processes.

17 Claims, 3 Drawing Sheets

TURBULENT MESOPHASE PITCH PROCESS AND PRODUCTS

CROSS REFERENCE TO RELATED APPLICATIONS

This application claims the benefit of prior provisional application No. 61/517,964, filed Apr. 28, 2011, which is incorporated by reference.

FIELD OF THE INVENTION

This invention relates to the formation of mesophase pitches useful for the production of carbonized fibers, carbon foam and other carbon or pitch based products.

BACKGROUND OF THE INVENTION

Mesophase pitch is an important and only relatively recently recognized member of the pitch family. Mesophase pitch has optical properties and can be used to make carbon fibers, carbon foam and other exotic and valuable materials.

When natural or synthetic pitches having an aromatic base are heated under quiescent conditions at a temperature in the range of 350° C. to 500° C., small insoluble liquid spheres begin to appear in the pitch and gradually increase in size as heating is continued. When examined by electron diffraction and polarized light techniques, these spheres are shown to consist of layers of oriented molecules aligned in the same direction. As these spheres continue to grow in size as heating is continued, they come in contact with one another and gradually coalesce with each other to produce large masses of aligned layers. As coalescence continues, domains of aligned molecules much larger than those of the original spheres are formed. These domains come together to form a bulk mesophase wherein the transition from one oriented domain to another sometimes occurs smoothly and continuously through gradually curving lamellae and sometimes through more sharply curving lamellae. The differences in the orientation between the domains create a complex array of polarized light extinction contours in the bulk mesophase corresponding to various types of linear discontinuity in the molecular alignment. The ultimate size of the oriented domains produced is dependent upon the viscosity and the rate of increase of the viscosity of the mesophase formed, which in turn is dependent upon the particular pitch and the heating rate. In certain pitches, domains having sizes in excess of two hundred microns up to in excess of one thousand microns are produced. In other pitches the viscosity of the mesophase is such that only limited coalescence and structural rearrangement of layers occur so that the ultimate domain size does not exceed one hundred microns.

The highly oriented, optically anisotropic insoluble material produced by treating pitches in this manner has been given the term "mesophase", and pitches containing such material are known as "mesophase pitches". Such pitches when heated above their softening points are mixtures of two essentially immiscible liquids, one optically anisotropic oriented mesophase portion and the other the isotropic non-mesophase portion. The term "mesophase" is derived from the Greek "mesos" or "intermediate" and indicates the pseudo-crystalline nature of this highly oriented, optically anisotropic material. Mesophase is in essence a "liquid crystal" since it has an orderly and repeating arrangement of its atoms as evidenced by its X-ray diffraction pattern and yet is capable of flow when stress is applied. This seemingly contradictory behavior results from the rather weak bonding of carbon atoms in adjacent parallel planes.

In a sense, mesophase pitch is just a stopping point along the way of thermal condensation of hydrocarbons into coke. As time and temperature increase, aromatic liquid hydrocarbons thermally polymerize with some thermal de-alkylation. If the atmospheric or vacuum residual of an aromatic crude oil is thermally treated, the first stop is vis-broken crude with a lower viscosity and lower molecular weight than the feed. The next stop along the thermal treatment route is dominated by thermal polymerization yielding petroleum pitch. The end of the line is coke. Mesophase pitch is the penultimate stop. Although the thermal processes can be briefly explained, myriad processes for making mesophase have been proposed or at least patented.

To better explain our new process, a review of generic information about pitch follows. This review covers a discussion of end products, patents about producing mesophase including our prior patents on the topic, and a discussion of multiple types of mesophase.

The term pitch has been used for many heavy products, ranging from a residual fraction of crude oil to the product of thermal polymerization. As used herein, pitch is intended to refer to the highly aromatic material with a softening point greater than 100° C. produced by thermal polymerization.

Petroleum pitches have been made for decades by refiners. Perhaps the most widely known material is A-240 pitch and/or M-50 produced by Ashland Petroleum Company and subsequently Marathon Oil Company respectively. Such pitches with suitable softening points can be used satisfactorily as an impregnation material for electrodes, anodes, and carbon-carbon composites, e.g., carbon-carbon fiber composites, such as aircraft brakes and rocket engine nozzles. These pitches can also be used in the nuclear industry for the preparation of fuel sticks and control rods for a graphite moderated reactor. Furthermore, such pitches can be used as a starting material for the production of mesophase pitch which can be used in the production of carbon fiber precursors and carbonized fibers, i.e. carbon fibers and graphite fibers. Carbon foams and other pitch-based products can be made as well from mesophase pitch.

High strength per weight ratio of carbon and graphite fibers, alone or in composites, makes such fibers useful in sporting equipment, automobile parts, light-weight aircraft, and several aerospace applications. High thermal conductivity and strength make carbon foam useful for thermal management applications and more. The end products, carbon fiber, carbon foam and the like, are high value specialty products which rely heavily on the properties of the starting material, the mesophase pitch.

A more or less chronological review of pitch preparation and pitch use patents follows. In U.S. Pat. Nos. 3,974,264 and 4,026,788, McHenry discloses producing carbon fibers from pitch. A non-thixotropic spinnable mesophase pitch having a mesophase content in the range of about 40 wt % to about 90 wt % is produced with shorter processing time by passing an inert gas through the pitch at a temperature in the range of 350° C. to 450° C.

In U.S. Pat. Nos. 3,976,729 and 4,017,327, Lewis, et al. disclose preparation of a non-thixotropic mesophase pitch while agitating the pitch during formation of the mesophase in order to produce a homogeneous emulsion of the immiscible mesophase and non-mesophase portions of the pitch. Improved rheological and spinning characteristics result from heating the pitch in an inert atmosphere at a temperature in the range of 380° C. to 440° C. for a time sufficient to produce a mesophase content in the range of 50 wt % to 65 wt % while agitating the pitch during the formation of the mesophase. A smaller differential between the average molecular weights of the mesophase and non-mesophase portions of the pitch also occurs.

In U.S. Pat. No. 3,995,014, Lewis discloses subjecting pitch to a reduced pressure during formation of the mesophase in order to substantially reduce the time otherwise required for its preparation.

In U.S. Pat. No. 4,005,183, Singer discloses a process for forming high-modulus, high-strength carbon fibers having a highly oriented structure containing crystallites. A mesophase-containing fiber is heated in an oxygen-containing atmosphere at 250° C. to 400° C. for a time sufficient to render it infusible, and then heated in an inert atmosphere to at least 1,000° C.

In U.S. Pat. No. 4,080,283, Noguchi, et al. disclose continuous production of pitch from a heavy hydrocarbon oil by mixing with an inactive gas such as nitrogen or steam, and heating the mixture at a temperature between 350° C. to 500° C. serially in a plurality of reactors with a portion of the liquid output from at least one of the reactors being re-circulated. The liquid output of the final reactor can be charged to an after-treatment duct-shaped chamber with an inactive atmosphere to cool said liquid output. Such operation provides uniformity of reaction conditions in the reactor system.

In U.S. Pat. No. 4,184,942, Angler, et al. disclose producing an optically anisotropic, deformable pitch from a carbonaceous isotropic pitch by initially heating at between 350° C. to 450° C. and then extracting with an organic solvent system. The solvent-insoluble fraction can be converted into an optically anisotropic pitch.

In U.S. Pat. No. 4,208,267, Diefendorf, et al. disclose producing an optically anisotropic, deformable pitch from the solvent-insoluble fraction of a carbonaceous isotropic pitch that has been extracted with an organic solvent, e.g. such as benzene or toluene. The solvent-insoluble fraction is heated for ten minutes or less to temperatures between 230° C. to 400° C. to yield an optically anisotropic phase of greater than 75 wt %. The phase contains less than about 25 wt % of substances unextractable with quinoline at 75° C.

In U.S. Pat. No. 4,209,500, Chwastiak discloses producing both a single-phase, essentially 100% anisotropic mesophase pitch having number average molecular weight below 1000, a net pyridine insoluble content no greater than 60% by weight, a softening temperature no greater than 350° C., and a viscosity no greater than 200 poises at 380° C. and carbonaceous fibers therefrom. An inert gas is passed at a sufficient rate through an isotropic carbonaceous pitch while heating said pitch at between 380° C. to about 430° C. to agitate the pitch sufficiently to produce a homogeneous emulsion of the mesophase and to ensure removal of volatile low-molecular weight components. "Inert gas" is meant to be a gas which does not cause a significant change in the chemical nature of the pitch materials being contacted at the process conditions of temperature and pressure.

In U.S. Pat. No. 4,402,928, Lewis, et al. disclose producing a carbon fiber from precursor material such as ethylene tars, ethylene tar distillates, gas oils derived from petroleum refining, gas oils derived from petroleum coking, aromatic hydrocarbons, and coal tar distillates having at least 50% by weight which boils under about 300° C. and at least about 70% by weight which boils under 360° C. One of these precursor materials is heated in batches under pressure to obtain a pitch which is solvent extracted to obtain a 70% by weight or greater mesophase portion. The insoluble mesophase portion can be converted into a carbon fiber.

In U.S. Pat. No. 4,460,557, Takashima, et al. disclose producing carbon fibers by heating a pitch to between 340°-450° C. under a stream of inert gas, such as nitrogen at up to atmospheric pressure, melt spinning the resulting material to form pitch fibers, then infusibilizing and carbonizing or graphitizing them.

In U.S. Pat. No. 4,504,455 and European Patent Application 813058930, Publication No. 0054437, Otani, et al. disclose a carbonaceous pitch comprising quinoline-soluble dormant anisotropic hydrocarbon components that are partially hydrogenated mesophase portions of a mesophase pitch. The carbonaceous pitch is optically isotropic in nature with a dormant mesophase which is orientable when subjected to shear forces. The dormant mesophase pitch is prepared by hydrogenating the mesophase of a mesophase pitch until substantially all the mesophase is quinoline-soluble. Production of a carbon fiber from these pitches is also disclosed. In the European application, the dormant mesophase pitch is prepared by solvent extracting mesophase pitch into quinoline-insolubles and quinoline solubles and then hydro-treating the quinoline insoluble portion. The higher the measured quinoline-insoluble fraction, the higher the amount of mesophase components present.

In U.S. Pat. No. 4,528,087, Shibatani, et al. disclose producing with extraction, a mesophase pitch containing 40% or more of quinoline-soluble. A pitch with an aromatic hydrogen content of 50% to 90% is heated to 430° C.-550° C. while passing an inert gas thereover until at least 40% mesophase is formed.

In U.S. Pat. No. 4,529,498, Watanabe discloses producing a 100% mesophase pitch of quinoline-insoluble and quinoline-soluble components by (1) heating a petroleum derived pitch to a temperature of 360°-450° C. while stirring under a low molecular weight hydrocarbon gas atmosphere at atmospheric or super-atmospheric pressure until the mesophase content is 10% to 50% to form a heat treated pitch, (2) holding without stirring the heat treated pitch at a temperature in excess of 280° C., but below 350° C., to permit separation into a layer of non-mesophase and a layer of mesophase, and (3) separating the non-mesophase layer from the mesophase layer. High-strength, high-modulus carbon fibers can be produced from the resulting mesophase layer.

In U.S. Pat. No. 4,529,499, Watanabe adds to the method of U.S. Pat. No. 4,529,498 by subjecting separated non-mesophase material to steps (1), (2), and (3) at least 3 times to prepare a 100% mesophase composed only of quinoline-insoluble and quinoline-soluble components.

In U.S. Pat. No. 4,575,411, Uemura, et al. disclose producing a melt-spinnable carbon fiber precursor pitch with a softening point between 200° C. to 280° C. by heating a film of 5 mm or less of a carbonaceous pitch at a temperature of 250° C. to 390° C. and at a pressure of 100 mm Hg or less until the precursor pitch contains 40% or more mesophase material. The mesophase pitch has 0 wt % to 40 wt % of an anisotropic quinoline-insoluble phase and 85 wt % to 100 wt % of an anisotropic quinoline-soluble phase.

In U.S. Pat. Nos. 4,497,789 and 4,671,864, Sawran et al. disclose producing substantially non-mesophasic pitch with a wiped-film evaporator.

In U.S. Pat. No. 4,976,845, Oerlemans, et al. disclose producing mesophase pitch using a wiped film evaporator.

In U.S. Pat. No. 5,238,672 and a Division thereof, U.S. Pat. No. 5,614,164, Sumner et al. disclose agitating heavy isotropic pitch at a temperature in the range of about 327° C. to about 454° C. for a time sufficient to produce a mesophase pitch having a minimum mesophase content of about 60 vol. %. An example showed distilling a commercially available isotropic pitch, A-240, in a wiped film evaporator to make a heavy isotropic pitch. This heavy pitch was converted to mesophase by gentle heating in a stripping vessel to 404 C and agitation with bubbling nitrogen gas for 4½ hours.

Chwastiak's method in U.S. Pat. No. 4,209,500 involving stripping requires a relatively long time to obtain mesophase spinnable pitch from a base pitch. Not only is stripping time consuming, but also high-molecular weight materials can be carried over with low-molecular weight materials during stripping due to foaming and the like. The volatile carry over from stripping may lose potentially useful components hard to recover due to the presence of highly diluting stripping gases and highly cracked materials that increase with residence time at high temperatures.

The method of Diefendorf, et al. in U.S. Pat. No. 4,208,267 involves a solvent extraction to remove low-molecular weight component which is rather difficult to practice.

Carbonaceous materials (sometimes called fiber precursors) for the manufacture of carbon or high-strength graphite fibers, conventionally employ polyacrylonitrile or mesophase pitch. However, preparation of mesophase pitch requires a time-consuming and expensive batch process of heating at an elevated temperature for a number of hours, as shown by Lewis, et al. in U.S. Pat. No. 3,967,729, by Singer in U.S. Pat. No. 4,005,183, and by Schulz in U.S. Pat. No. 4,014,725. Improper heating can increase viscosity of mesophase pitch so much that it is rendered unsuitable for spinning. Also, polyacrylonitrile is often a more expensive feedstock than is mesophase pitch.

In U.S. Pat. No. 6,833,012, Rogers reviews methods of making mesophase pitch.

Pitch formation is a thermal process involving thermally induced polymerization. The product has a higher molecular weight than the feed. In contrast, there are other thermal refinery processes which use heat to crack or dehydrate the feed. These processes produce products with lower molecular weights than the feed. Thermal cracking processes such as visbreaking, e.g., a thermal cracking process widely licensed by Universal Oil Products, used high temperature to thermally crack high molecular weight components of crude oil to create its own cutter stock, reducing the viscosity of the heavy fuel oil product. Steam cracking of naphtha or other light, usually paraffinic, feeds to olefins is an important method to produce ethylene and other light olefins. Steam and naphtha are mixed together and fed through a heater at ultra high temperatures as high as 850° C. and at velocities exceeding the speed of sound, then quenched. Styrene production, although catalytic, uses large amounts of superheated steam to heat an ethylbenzene feed to a temperature where it can catalytically and endothermically be converted to styrene.

The state of the art on making mesophase pitch could be summarized as follows. There are many processes most involving relatively long batch processes which allow mesophase to form. Some are continuous and use intense mechanical agitation after using a wiped film evaporator to remove a substantial amount of distillate material or agitation by injection of an inert gas. All are difficult to control and, because the temperatures are high, the mesophase pitch precursor and the pitch product can form coke. Mesophase formation is generally enhanced by low pressure to strip off lighter byproducts or relatively light materials which may be present during thermal polymerization. These processes require residence times of hours up to days to produce the desired mesophase product.

Our recent patent activity will be reviewed next.

Our first U.S. Pat. No. 7,220,348 teaches a way to use superheated steam to effectively steam strip pitch in order to produce a higher softening point pitch with an ultra low residence time of less than 1 second. No mesophase production was reported in the examples. Our second U.S. Pat. No. 7,341,656 teaches use of steam and an oxidant to produce mesophase pitch.

U.S. Pat. No. 7,220,348, Malone et al, assigned to Marathon Ashland Petroleum LLC, taught a way to make a high softening point pitch. The examples showed contacting an A-240 pitch with superheated steam. The softening point of the pitch was increased, indicating that something akin to steam stripping or removal of lighter components by distillation had occurred. Although the term mesophase was used, and even included in the examples and Tables reporting experimental results, all examples showed that at the conditions used "nil" mesophase was found in the product.

U.S. Pat. No. 7,341,656, Malone et al, assigned to Marathon Ashland Petroleum Co LLC, was for a CONTINUOUS OXIDATION AND DISTILLATION PROCESS OF HEAVIER HYDROCARBON MATERIALS. The patent is primarily directed to an improvement on a used lube oil re-refining process, but does mention other feeds such as slurry oil, asphalt or petroleum pitch. The process heats the heavy feed by contact with superheated steam and an oxidizing gas. Combustion heats the feed, promoting fractionation. The heavy feed, steam and oxidant are mixed in a nozzle and discharged into a vessel. The process conditions include "a superficial velocity of no greater than about 5.5 feet per second, preferably no greater than about 3 feet per second." Velocities are limited to limit entrainment of liquid. In Example 1, the only example in the patent, pressure is not reported, however the patent reports that the "steam-light overhead mixture was cooled first to 225° F., where most of the overhead product condensed. The steam was condensed and collected in a water condensate accumulator." From the temperature reported, i.e. 225° F., the pressure was slightly above atmospheric. The teachings of this patent could be summarized as steam stripping plus oxidation may be used to heat and volatize light components from used motor oil. Other streams may also be heated.

While there is a voluminous amount of art on making mesophase pitch, none have been completely satisfactory. The reaction is simple—thermal polymerization and usually some thermal de-alkylation, but difficulties have been encountered in the past in trying to make a reliable process. It is easy to make mesophase pitch from any aromatic containing starting material—every delayed coker forms mesophase and promptly turns it into low value coke. Slow processing by working with a temperature just at the threshold of that needed to induce thermal polymerization and careful control of temperature has worked to some extent in the past. The slow processing gives some control over the process. Other processes used high temperatures and intensive mechanical working using wiped film evaporators to improve heat transfer, limit the residence time at high temperature, and prevent stagnant regions to minimize coke formation.

We wanted to develop a simple but robust process which did not require complicated expensive mechanical equipment and which was not prone to fouling by coke formation. We did not want to resort to an in-situ combustion approach to generate the high temperatures needed for mesophase formation because this complicates the design of the plant and may impact the quality of the products and certainly of the byproducts which are burned.

We were doing some experiments in the laboratory which were somewhat related to our prior patents that used steam, or steam and an oxidant to distill pitch. We used a long tube reactor and relatively severe thermal conditions at slightly above atmospheric pressure to keep more of the feed components in liquid phase. We discovered that it was possible in a long tube reactor to create significant amounts of mesophase pitch even with short residence times on the order of 0.1 second. Others had converted petroleum pitch with a softening point of about 240° F. to mesophase, but they required a residence time of hours to days. They were able to shorten the residence time to an hour or two using intense mechanical agitation after processing in a wiped film evaporator. In summary, we were able to make mesophase pitch in orders of magnitude less time, using a simple long tube or pipe reactor. Processing conditions were fairly intense. It is hard to determine exactly what flow regime occurred in the pipe, it may have been fully developed turbulent mist-annular flow. It is possible that some, or perhaps even much or all, of the flow in the tube was spray or mist annular. The important factor is to have intense mixing, with the intensity was provided by fluid dynamics rather than mechanically.

This discovery—that significant amounts of mesophase could be made in less than one second if the temperature was high enough and the conditions turbulent—was the starting point on our new route to mesophase pitch.

Our starting material can be identical to the starting material of most pitch processes, e.g., a conventional petroleum pitch. We used A240, a widely used product that is no longer commercially made. Our approach, however, is different from other processes. Rather than take a long time to make mesophase in a batch reactor or a somewhat shorter time in a wiped film evaporator, we make mesophase in seconds without any mechanical agitation. Rather than operate under vacuum, we prefer to operate near atmospheric pressure. Other processes used vacuum to remove light materials, but in our process steam is preferably added. Much of the heat required is provided by injecting superheated steam, but to keep the amount of steam injection low, we prefer to add additional heat by conducting the reaction in a heated long tube. This long tube is heated preferably with electric resistance or inductance heating, or by immersing the long tube in a salt bath or the like or by putting the tube in a fired heater. Uniform precise temperature control is helpful, but the flows through the tube are at such high velocity and the conditions within the tube so turbulent, that an ascending or descending or some other temperature profile can be used, if desired.

By using unusually high velocities in the long tube thermal reactor, we were able to create conditions which fostered rapid mesophase formation. Additionally, the flow regime was so vigorous that it was possible to operate the long tube reactor for a significant time without coke formation despite the high temperatures used.

In addition to being a new route to mesophase, our new mesophase pitch may be a new composition of matter. As noted by Dr. James Klett, two materials can be called mesophase pitch but have significantly different molecular structures and different properties. Mesophase pitch made from naphthalene, Mitsubishi AR, has a softening point of 273° C. and a lower carbon yield of 78% as compared to a mesophase pitch made by a proprietary Conoco process from petroleum pitch which has a melting point of 355° C. and a carbon yield of 87%. (www-physics.lb1.gov/~gilg/ATLA-SUpgradeRandD/HighKFoam/Graphite_Foams.pdf)

Mesophase pitch produced by the invention described herein has been analyzed to have a softening point (ASTM D3104) of 323° C., a mesophase content (ASTM D4616) of 82% vol, a quinoline-insoluble (QI) content (ASTM D2318) of 34.7% and a coking value (ASTM D2416) of 90%. Mesophase pitches with different properties can be made by operating the instant invention at different conditions. It is remarkable that a mesophase pitch with a mesophase content of 82% and a coking value of 90% would have a QI of less than 35%. Typically the QI for such a pitch would be 55% or higher. Generally a low QI for a given mesophase content is considered to be highly desirable.

BRIEF SUMMARY OF THE INVENTION

The present invention provides a process for producing mesophase pitch from an aromatic liquid feed comprising charging an aromatic liquid feed and a vapor source to a reactor operating at thermal polymerization conditions, maintaining thermal polymerization conditions in said reactor including turbulent flow and a temperature sufficient to induce thermal polymerization of said feed into mesophase pitch and high enough to produce coke, and discharging a mesophase pitch containing product stream from said reactor after a residence time of less than one minute and long enough to convert a majority by weight of said feed to mesophase pitch and short enough to prevent or reduce formation of coke and wherein at least an order of magnitude more mesophase pitch is produced than coke.

In another embodiment, the present invention provides a process for producing mesophase pitch comprising mixing in a long tube reactor, a liquid hydrocarbon feed comprising an isotropic pitch with steam to produce a pitch liquid and steam mixture at thermal polymerization processing conditions sufficient to thermally polymerize said isotropic pitch to an anisotropic pitch, mesophase pitch; thermally polymerizing said isotropic pitch in said long tube reactor at said thermal polymerization conditions including turbulent flow to produce a mixture of liquid mesophase pitch and vapor comprising said steam and lighter hydrocarbon byproducts produced during said thermal polymerization; and discharging said mixture of liquid mesophase pitch, steam and lighter hydrocarbons from an outlet of said long tube reactor and separating and recovering mesophase pitch as a product of the process.

In another embodiment, the present invention provides a mesophase pitch composition comprising at least 80 wt % mesophase with a coking value of at least 90 wt % and a QI content of less than 35 wt %.

In yet another embodiment in a continuous process for converting isotropic pitch to mesophase pitch by charging a feed isotropic pitch, having a boiling range and wherein at least a majority of said feed is a nondistillable residue liquid, to an inlet of a tubular reactor having tube walls and operating at thermal polymerization conditions including a pressure and a temperature and for a time sufficiently high to thermally polymerize at least a portion of said isotropic pitch feed to mesophase pitch and to thermally crack and dealkylate at least a portion of said isotropic pitch feed to vaporizable hydrocarbons having a boiling point below that of said isotropic pitch feed and coke as an undesired byproduct which deposits within said tubular reactor, the improvement comprising adding water or steam to said tubular reactor at a weight ratio of water or steam to isotropic pitch feed of 1:10 to 10:1, maintaining said pressure low enough and said temperature high enough in said tubular reactor to maintain at least a majority, by volume, of material in said tubular reactor in vapor phase, maintaining residence time and temperature in said tubular reactor sufficient to convert a least a majority, by weight, of said isotropic pitch feed to mesophase pitch and vaporizable materials having a boiling range below said isotropic pitch feed, and wherein said isotropic pitch feed rate, said water or steam addition, and velocity in said tubular reactor are sufficient to reduce coke deposition within the walls of said tubular reactor to less than 0.001 "/hr.

DETAILED DESCRIPTION OF PREFERRED EMBODIMENTS

Figure 1:
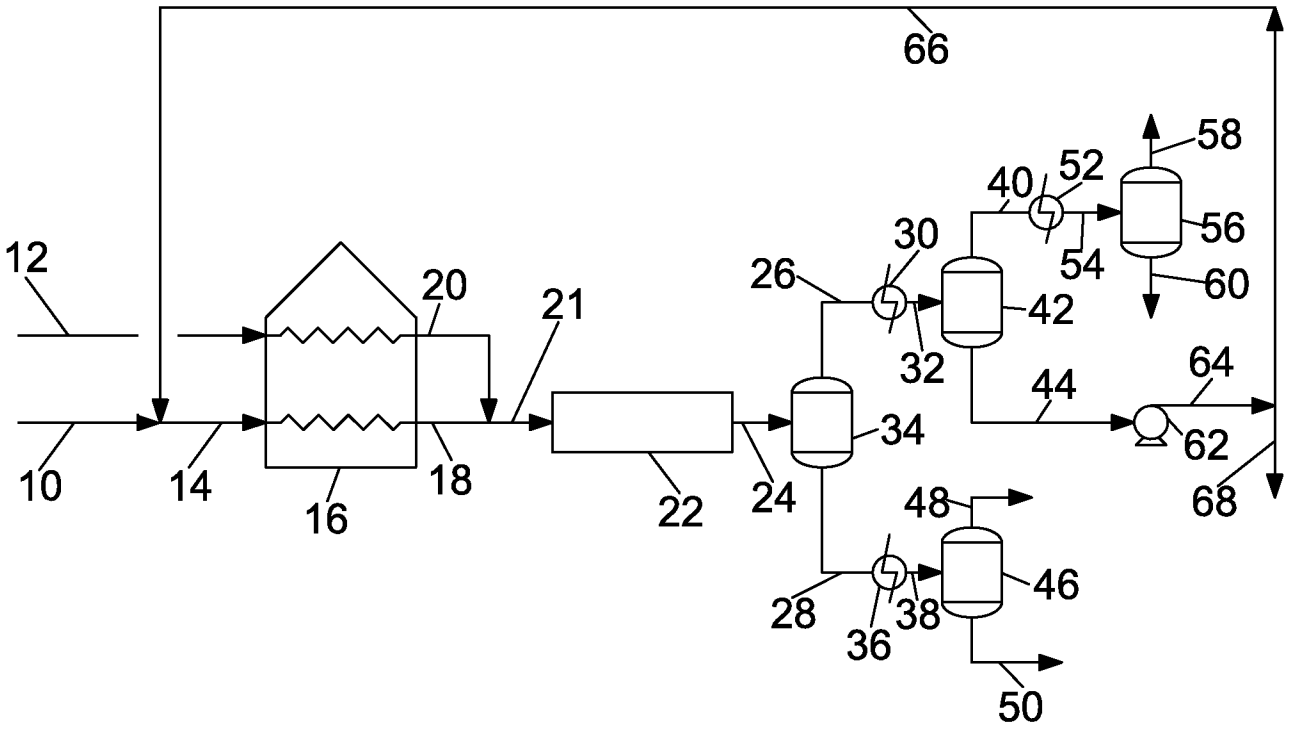
FIG. 1 is a simplified process flow diagram of the process for producing mesophase pitch.

Referring to FIG. 1, fresh feed 10 mixes with distillate recycle 66 to comprise one fired heater 16 inlet stream 14. Stream 12 is superheated separately in the fired heater 16. Superheated steam 20 and heated feedstock combine to comprise the inlet 21 to a precision heater 22. The typical velocity in the precision heater 22 varies from 30.5 to 305 msec (100 to 1,000 ft/sec). The outlet of the precision heater 24 enters a liquid-vapor disengaging means. This may be an empty vessel, a vessel with internals, a liquid-vapor cyclone or some other means for liquid-vapor disengaging. The vapor 26 from the disengager 34 flows to a heat exchanger 30 that cools the stream to a temperature above the saturation temperature of water for the given pressure of operation. The outlet 32 of the heat exchanger 30 flows to a second liquid-vapor disengager 42. The vapor stream 40 from the disengager 42 flows to a second heat exchanger 52 where nearly all of the steam and a minor amount of light hydrocarbons condense. The stream 54 from the outlet of the second heat exchanger 52 flows to a third disengaging vessel 56. Light gases 58 exit the top of the disengager 56. Water and light hydrocarbon liquids are withdrawn via line 60, but can be separately withdrawn by means not shown from the disengager 56. The liquid stream 44 from the second disengager 42 is a highly aromatic heavy distillate stream. It flows to a pump 62 and is discharged via line 64 where it may become a recycle stream 66 or it may be withdrawn as product stream 68 for other uses.

The residue withdrawn via line 28 from the first vapor-liquid separator 34 may be cooled by heat exchanger 36. The outlet stream 38 of heat exchanger 36 may flow to a vessel 46 for further processing. The product stream 50 of this vessel 46 is mesophase pitch. A minor amount of vapor 48 may be generated in vessel 46. This stream may be incorporated into the fuel gas system or burned in a flare.

Figure 2:
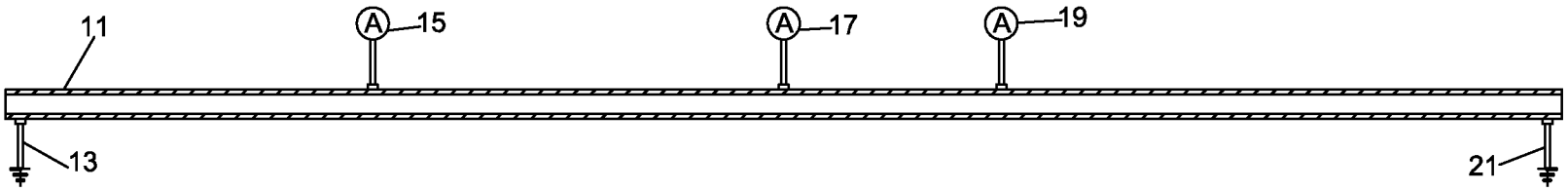
FIG. 2 is a simplified process flow diagram illustrating a means to achieve precise, uniform temperature control of the process fluid.

FIG. 2 illustrates a particular precision temperature heater and/or reactor means for very accurately and uniformly controlling the temperature of a fluid being heated and/or reacted. A standard pipe or tube 11 of the appropriate metallurgy (for these conditions Austenitic stainless steel), thickness, internal diameter and length is a flow conduit for the stream heated or reacted in FIG. 1. Current sources 15, 17 and 19 add or withdraw current to or from the walls of conduit 11. Electrical ground connections 13 and 21 ensure that no significant electrical current flows to other parts of the process. Electrical current passing through the length of the conduit wall produces heat proportional to the resistance of the conduit wall. No other electrical effect such as inductive coupling is intended. One embodiment of this device uses direct current, DC as opposed to alternating current, AC. While AC will provide nearly identical resistance heating capabilities as DC, it may induce unwanted currents in equipment such as instruments and other electrically conductive materials. DC minimizes this effect.

As electrical current may flow into or out of the conduit walls 11 through the current sources 15, 17 and 19, it should be apparent to those skilled in the art that the section between current source 15 and the ground connection 13 could be a precision preheater. Similarly the section between current source 15 and current source 17 could be controlled to a particular temperature. The section between current source 17 and current source 19 could be controlled to a second predetermined temperature. The section between current source 19 and ground connection 21 could be controlled to a third predetermined temperature.

One embodiment of this device uses a coiled conduit 11. The coils are sufficiently separated and electrically insulated such that there is no short-circuiting between the coils or to unintended electrical grounds. A coiled arrangement allows for a compact reactor system for long conduit 11 lengths especially for conduit 11 outside diameters less than 25 mm.

Another embodiment of this device uses straight lengths of conduit 11 with 180° return bends. The plane passing through the straight lengths of conduit can be vertical, horizontal or something intermediate. This arrangement also allows for a compact reactor system for long conduit 11 lengths especially for conduit 11 outside diameters greater than 50 mm.

Precision heater means and reactor temperature control means other than that described above could be used in the process described in FIG. 1. For example skin effect induction as described in U.S. Pat. Nos. 3,665,154 and 3,975,617 could be used in place of the heaters and temperature controlled reactors described above.

Figure 3:
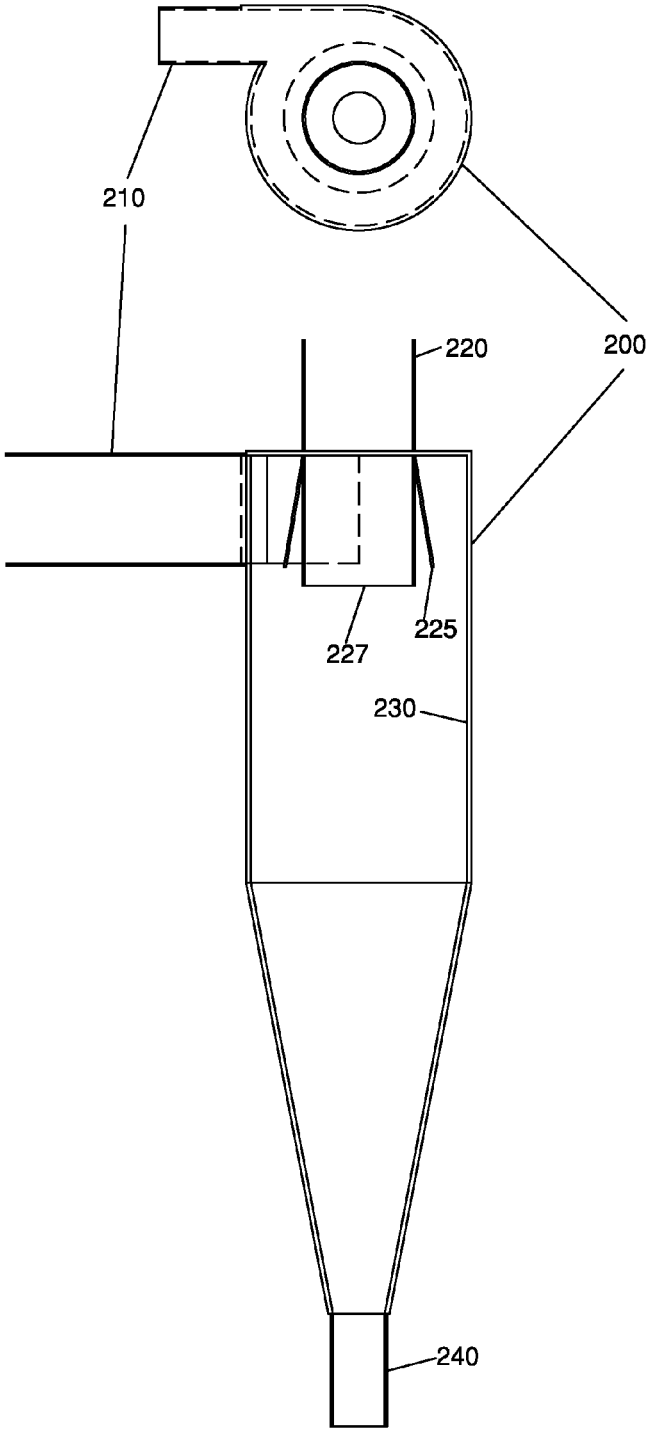
FIG. 3 depicts a preferred cyclone separator for recovering mesophase pitch product.

In FIG. 3, a vapor phase mixture of liquid mesophase pitch droplets entrained in a vapor is charged into inlet 210 into cyclone separator 200. The mixture of vapor and entrained liquid swirls around cyclone vapor outlet pipe 220. Liquid tends to be thrown to the sides of the separator. Liquid collects on the interior walls 230 of the separator and is discharged down the generally funnel shaped lower portion of the separator and is discharged via liquid outlet 240. Vapor is withdrawn via the outlet pipe 220. A flared skirt 225 is attached to a lower portion of outlet tube 220. The function of the skirt 225 is to displace radially collected liquid pitch droplets which otherwise could collect near the base of outlet tube 225. These liquid droplets if discharged near inlet 227 of outlet tube 220 could be entrained into the substantial amounts of vapor entering the inlet. It is important to have essentially complete separation of entrained mesophase pitch droplets from vapor because the mesophase has such a high softening point that it can readily condense into a solid and clog downstream processing equipment. In the view of the high temperatures at which the process operates, typically 900 to 1000° F., any liquid droplets can turn to coke in just a few minutes so it is important to minimize and preferably eliminate any long term residence time in or near the vapor tube outlet.

The physical properties of, and some test methods for, various feed and product streams are reviewed next.

Feedstock: Preferably an isotropic pitch with a softening point above 50° C., preferably above 100° C. and ideally above 110° C., is used as the starting material. We prefer to use petroleum pitch such as M-50 recently produced by Marathon Oil Company, A-240 as previously produced by Ashland Petroleum Company, or a petroleum pitch having softening point (ASTM D3104) of 100-150° C., coking value of at least 45% (ASTM D2416), ash less than 0.1% w (ASTM D2415), QI less than 0.5% (ASTM D2318) and flash point greater than 240° C. (ASTM D92). It is possible to use other starting materials if the feeds do not contain or are modified to remove undue amounts of light ends.

The desired product is preferably a high softening point mesophase pitch material having a normal-heptane insoluble content (ASTM D3279-78) of about 85 wt % to about 100 wt % and the properties set forth below in Table I. These properties will allow the mesophase pitch to be used in many commercial applications.

TABLE I

Mesophase Enriched Pitch Properties

| Property | Broad | Preferred | More Preferred |
|---|---|---|---|
| Softening Point ° C. | 177-399 | 288-357 | 316-327 |
| Coking Value (wt %) | 60-95 | 71-93 | 89-91 |
| Tg.sup. (1) ° C. | 124-316 | 232-280 | 238-270 |
| Mesophase Content (vol %) | 5-100 | 60-95 | 75-100 |
| Toluene Insolubles (wt %) | 20-100 | 60-100 | 80-90 |
| Quinoline Insolubles (wt %) | 0-95 | 25-80 | 30-70 |
| Helium Density.sup. (2), gm/cc | 1.25-1.35 | 1.30-1.33 | 1.30-1.33 |
| Sulfur (wt %) | 0.1-3 | 0.1-2 | 0.1-2 |

(1) Glass Transition Temperature (2) Determined by Beckman Pycnometer, gm/cc @ 25° C.

The softening point, i.e., Mettler softening point, is measured by methods well known to those skilled in the art, preferably, ASTM D3104, modified to use stainless steel cups and a Mettler Softening Point Apparatus with a high-temperature furnace in view of the high softening points of the pitches involved. The sample chamber is purged with nitrogen in order to prevent oxidation. The coking value, in terms of wt %, is determined by ASTM D2416 and largely represents the residual carbon after all processing has been completed.

The mesophase content was obtained by ASTM method D-4616 using a polarized-light microscope with a rotating stage and a means for quantitatively distinguishing the relative abundance of mesophase areas, which are optically active, from that of the optically inactive, non-mesophase areas. The isotropic pitch which can be used as the feedstock for mesophase production typically will have the properties set forth in Table II.

TABLE II

Isotropic Pitch Properties

| Property | Broad | Preferred | More Preferred |
|---|---|---|---|
| Softening Point ° C. | 127-288 | 232-277 | 256-268 |
| Coking Value (wt %) | 55-90 | 71-85 | 78-85 |
| Tg ° C. | 77-243 | 171-238 | 200-216 |
| Mesophase Content (vol %) | 5 max | 2 max | 1 max |
| Toluene Insolubles (wt %) | 6-50 | 25-45 | 30-40 |
| Quinoline Insolubles (wt %) | 0-5 | 0-1 | 0-0.5 |
| Helium Density.sup. (1), gm/cc | 1.25-1.32 | | |
| Sulfur (wt %) 0.1-4 | | | |

(1) Determined by Beckman Pycnometer, gm/cc @ 25° C.

The aromatic heavy isotropic pitch material, also referred to as "mesophase precursor pitch", can be prepared from either an unoxidized, highly-aromatic, high-boiling fraction obtained from the distillation of crude oils, or preferably, from pyrolyzed heavy aromatic slurry oil from the catalytic cracking of petroleum distillates. Ethylene cracker bottoms (ECB) is similar to slurry oil and may also be used to make pitch. Pitch produced from these aromatic rich streams is sometimes referred to as "catalytic pitch". The heavy isotropic pitch material can be further characterized as an aromatic heavy isotropic thermal petroleum pitch.

The pitches that can be utilized as a starting material to make mesophase pitch are preferably characterized by a combination of parameters presented in Table III.

TABLE III

Characterization Parameters for Catalytic or Isotropic Pitch

| | Operable | Preferred |
|---|---|---|
| Softening Point ° C. | about 93-232 | 110-149 |
| Toluene Insolubles (wt %) | 0-10 | 0-8 |
| Quinoline Insolubles (wt %) | 0-1 | nil |
| Coking Value (wt %) | <about 55 | <about 48 |
| Carbon/hydrogen Atomic Ratio | >about 1.2 | >about 1.3 |
| Mesophase Content (%) | <about 5 | 0-2 |
| Tg, ° C. | >about 35 | >about 85 |
| Ash (wt %) | 0-0.2 | 0-0.1 |

Typically, the isotropic pitches utilized in the processes of the present invention are prepared from heavy slurry oil produced in the catalytic cracking of petroleum fractions or from ethylene cracker bottoms. Such pitches remain rigid at temperatures closely approaching their melting points.

Although the "fresh feed" for the mesophase pitch process is preferably a material having the properties shown in Tables II and III, the process tolerates well feeds which have relatively large amounts of impurities or are off specification. Significant amounts of light ends ranging from naphtha boiling range materials to gas oil or diesel boiling range may be present and are tolerated well by the process of the present invention. These may be added to the feed pitch as a solvent or diluent to facilitate processing of the relatively heavy pitch feeds such as A240 and the like.

Process Conditions

Preheated feedstock 315 to 482° C. (600 to 900° F.) is preferably mixed with superheated steam 315 to 600° C. (600 to 1112° F.) at the inlet of a precision heated tube. Inlet pressure may be 341.74 kPa to 683.48 kPa (50 to 100 psig) or higher. Ratio of steam to feedstock ranges from 0.01 to 5 kg/kg, preferably 0.10 to 4.0 kg/kg, with 0.2 to 1 kg/kg giving good results. Residence time in the tubular reactor may vary from 1 minute to 0.00001 sec, with residence times below 10 sec, preferably below 2 seconds, more preferably below 1 sec, down to 0.1 sec or less being most preferred. The tubular reactor operates at temperatures from 480° to 595° C. (900 to 1100° F.), with 510 to 538° C. (950 to 1000° F.) preferred. Outlet pressure should be significantly less than reactor inlet pressure to facilitate flash separation of mesophase pitch from distillable components left in the feed or lighter components produced during the course of the reaction. The discharge pressure, or flash drum pressure can vary greatly, but operation with 6.895 kPa to 172.37 kPa, 108.25 kPa (1 to 25 psia, 15.7 psia) is preferred.

The vapor is separated from the residue by any appropriate liquid-vapor disengaging device such as a vessel or a preferred liquid-vapor cyclone. The flashed vapor is preferably condensed at more than saturation temperature of steam to avoid water condensation in a heat exchanger. The condensed vapor may be recycled to blend with the feedstock, used to produce isotropic pitch or sold as a highly aromatic hydrocarbon specialty chemical. A temperature of 104 to 110° C. has worked well for condensation of the flashed vapor. Water vapor and light hydrocarbons may be condensed downstream in a separate heat exchanger. The light hydrocarbons are decanted from the condensed water. The condensed water may be recycled to produce superheated steam.

The residue product which is the mesophase product collects in, e.g., the base of the flash vessel. Product residue is level controlled to storage. Product residue yield ranges from 35 to 55% of feedstock by weight. Product residue contains 70 to 90% or more mesophase (ASTM D4616), softening point of 300 to 350° C. (ASTM D3104) and coking value of 80 to 95% or higher (ASTM D2416).

Although use of the cyclone separator shown in FIG. 3 is preferred, it is not essential and other conventional means may be used to separate mesophase pitch liquid from vapors discharged from the long tube reactor. For example, a large quench stream could be added or recycled to rapidly cool the entire effluent stream and prevent thermal cracking or coking. Further fractionation, flashing, extraction or stripping of the mesophase product may then be required to obtain a mesophase product with the desired properties, but the prior art is replete with examples of ways to remove some amounts of undesired components from mesophase pitch streams. Use of the cyclone separator as shown in the Figures is preferred because the mesophase product has had "light ends" effectively removed at temperatures well above those which could be achieved in any conventional fractionator. Using a cyclone permits mesophase to be recovered hot and relatively pure, usually pure enough that no further processing will be required for many applications.

EXAMPLES

We used a 9.52 mm (⅜") outside diameter (OD) tube 15.24 m (50 ft.) long with a 0.711 mm (0.028") wall thickness made of type 316 L stainless steel (ss) heated by a Miller 300 CP welding machine that passed current through the reactor tube for our experimental studies. The results presented in the following table were generated in one continuous 30 hour operating period. The residue and overhead were drained every 2 hours. Samples from these drains were analyzed for softening point and once for coking value.

| Reactor Outlet | Pitch Yield | Softening Point, ° C., | Coking Value | Feedrate, kg/hr |
|---|---|---|---|---|
| 485° C. (905° F.) | 41.6% | 322.4 | 91.6% | 4.81 |
| 471° C. (880° F.) | 41.8% | 313.8 | | 4.97 |
| 466° C. (870° F.) | 43.8% | 288.3 | | 4.92 |

The superheated steam feed rate was approximately equal to the pitch feed rate for all tests. The unit was shut down in good working order after processing 146.9 kg of M-50 pitch as feed. This means that the average thickness of coke deposited on the inside tube wall was less than 0.0254 mm (0.001") or the pressure drop in the tube would have become unacceptable. We later produced 45.4 kg (100 lb.) of high mesophase pitch that we pulverized and mixed to produce a uniform sample. It had a softening point of 323° C., a coking value of 91%, and a mesophase content of 83%.

It is generally not necessary or often even desirable to produce a petroleum mesoophase pitch with a mesophase content in excess of 80%. In some cases the minor amount of isotropic pitch mixed with the mesophase pitch is beneficial as a lubricant in extrusion or spinning and nearly all of it converts to mesophase during the carbonization step.

DISCUSSION

While our experiments were all conducted with superheated steam, it is not necessary to use superheated steam, or even to add steam.

Steam was used as this was an efficient way to get some additional heat into the system and because of our belief that steam would be effective at reducing coking in our long tube reactor. Steam addition produces higher velocities in the tubes and can react with carbonaceous deposits at the high temperatures used. Steam may also react with intermediates that form during the reaction. Steam may not react at all and yet somehow retard coke formation. Steam addition can be achieved preferably by adding superheated steam or adding saturated steam or water. Even shredded ice could be added as both ice and water will rapidly form steam at the high temperatures used in our reactor. What is essential is turbulent flow and short residence time, less than 1-5 minutes, preferably less than a minute, more preferably less than 10 seconds, or 1 second or even 0.1 seconds.

It will usually not be possible to achieve turbulent flow and the high velocities in the tube reactor by simply charging a pitch material such as A240. The molecular weight of the feed is too high, and not enough vapor is present, or produced, to get the gas volumes needed to rapidly move things through the reactor. It may be possible to achieve the needed gas volumes and velocity by using an impure or solvent diluted feed stock, but for quality control and ease of operation, we prefer to start with a relatively pure pitch product having a softening point of 200-300° F. and having little or no mesophase content.

Other materials besides steam may be used to promote mixing and turbulent flow. As discussed above, steam is preferred because it is cheap, easy to work with, may hinder carbon formation, and can be removed from various vapor streams by cooling sufficiently to condense water from such vapor streams. Other inert gases may be added. These will achieve the high velocities and turbulent conditions desired, but may not hinder coke deposition on the walls of the tube.

Hydrogen may be used. Hydrogen can suppress coke formation and even hinder formation of, or perhaps rapidly saturate, olefins and dienes as they are formed. Relatively high pressure operation is required for hydrogen to be effective in this way. Capital costs for the plant increase greatly if, e.g., high pressure operation with hydrogen is contemplated. For some applications where extremely high purity mesophase pitch product is required, operation with 1-1000 atm of hydrogen partial pressure may be preferred. If hydrogen is used at low pressure, it will be relatively inert, but it will help move feed through the reactor. Other gases such as refinery off gas stream, helium, nitrogen and the like may be used. We prefer to avoid using oxygen or oxygen containing gas. Oxidants can supply some of the heat required, but will burn up some of the product. As the value of the mesophase product is high and in most regions the value of the byproducts is relatively low, in some circumstances use of an oxidizing gas coupled with high temperatures and short residence time can be justified.

The process of the present invention allows production of mesophase pitch product by converting in a single tubular reactor a pitch feed into a stream comprising primarily mesophase product and a minor amount of unconverted or partially converted feed. Ideally temperatures in the tubular reactor are sufficiently high and pressures in the flash separator sufficiently low that a mesophase pitch product stream may be obtained as a direct residue product of the process with unconverted or partially converted materials removed as a vapor phase.

The products of the new pitch process are believed unique. They include a mesophase pitch composition comprising at least 80 wt % mesophase and having a coking value of at least 90 wt % and a quinoline insoluble content of less than 35 wt %. Such a pitch will have less than 50% the diene content of prior art mesophase pitches. It should be noted that mesophase pitch has very little diene content and this is not normally considered a significant product property of mesophase pitch, but the reduced diene content is a characteristic of the mesophase product.

Byproducts of the mesophase pitch process are also unique in having a low level of olefins and low diene content. Olefines and dienes are markers for thermal cracking of feed. The liquid and vapor byproducts of the process of the present invention will have at an olefin content and a diene content less than 50%, preferably less than 10% that of byproducts from prior art mesophase pitch production processes.

We claim:

1. A process for producing mesophase pitch from an aromatic liquid feed comprising a.) Charging an aromatic liquid feed and a vapor source to a reactor operating at thermal polymerization conditions, b.) Maintaining thermal polymerization conditions in said reactor including turbulent flow and a temperature sufficient to induce thermal polymerization of said feed into mesophase pitch and high enough to produce coke, c.) Discharging a mesophase pitch containing product stream from said reactor after a residence time of less than one minute and long enough to convert a majority by weight of said feed to mesophase pitch and short enough to prevent or reduce formation of coke and wherein at least an order of magnitude more mesophase pitch is produced than coke.

2. The process of claim 1 wherein steam is present in the tubular reactor in an amount equal to 5 to 100 wt % of said liquid feed.

3. A process for producing mesophase pitch comprising:

a) Mixing in a tubular reactor, a liquid hydrocarbon feed comprising an isotropic pitch with steam to produce a pitch liquid and steam mixture at thermal polymerization processing conditions sufficient to thermally polymerize said isotropic pitch to an anisotropic pitch, mesophase pitch;

b) Thermally polymerizing said isotropic pitch in said tubular reactor at said thermal polymerization conditions including turbulent flow to produce a mixture of liquid mesophase pitch and vapor comprising said steam and lighter hydrocarbon byproducts produced during said thermal polymerization; and c) Discharging said mixture of liquid mesophase pitch, steam and lighter hydrocarbons from an outlet of said tubular reactor after a residence time of less than one minute and long enough to convert a majority by weight of said feed to mesophase pitch and separating and recovering mesophase pitch as a product of the process.

4. The process of claim 3 wherein said tubular reactor is heated in at least a portion of its length by electric resistance heating, electric induction heating, or both to maintain thermal polymerization conditions.

5. The process of claim 3 wherein said tubular reactor is heated in at least a portion of its length by heat exchange with a salt or molten metal bath or by placement inside of, or in a downstream convection section of, a fired heater.

6. The process of claim 3 wherein said thermal polymerization processing conditions include a pressure at an inlet portion of said tubular reactor of 45 to 215 psia and an outlet pressure of 1 to 20 psia.

7. The process of claim 6 wherein said reactor discharges a mix of mesophase pitch and unconverted or partially converted feed comprising materials boiling below 1000° F. and said thermal processing conditions include a temperature sufficiently high, and an outlet pressure sufficiently low, so that at least 90 wt % of said unconverted or partially converted feed materials are flashed as a vapor phase on discharge from said reactor from a liquid residue phase of mesophase pitch product.

8. The process of claim 3 wherein fully developed turbulent mist annular flow is maintained in at least a portion of said tubular reactor.

9. The process of claim 3 wherein said thermal polymerization conditions include a superficial vapor velocity in said tubular reactor is 50 to 2000 ft/sec.

10. The process of claim 9 wherein said superficial vapor velocity is 100 to 1000 ft/sec.

11. The process of claim 3 wherein said residence time is less than 10 seconds.

12. The process of claim 3 wherein said residence time is less than 1 second.

13. The process of claim 3 wherein said residence time is 0.05 to 0.5 seconds.

14. The process of claim 3 wherein steam is present in the tubular reactor in an amount equal to 5-100 wt % of said liquid feed.

15. In a continuous process for converting isotropic pitch to mesophase pitch by charging a feed isotropic pitch, having a boiling range and wherein at least a majority of said feed is a nondistillable residue liquid, to an inlet of a tubular reactor having tube walls and operating at thermal polymerization conditions including a pressure and a temperature and for a time sufficiently high to thermally polymerize at least a portion of said isotropic pitch feed to mesophase pitch and to thermally crack and dealkylate at least a portion of said isotropic pitch feed to vaporizable hydrocarbons having a boiling point below that of said isotropic pitch feed and coke as an undesired byproduct which deposits within said tubular reactor, the improvement comprising adding water or steam to said tubular reactor at a weight ratio of water or steam to isotropic pitch feed of 0.5:1 to 2:1, maintaining said pressure low enough and said temperature high enough in said tubular reactor to maintain at least a majority, by volume, of material in said tubular reactor in vapor phase, maintaining residence time of less than 10 seconds and temperature in said tubular reactor sufficient to convert at least ⅓, by weight, of said isotropic pitch feed to mesophase pitch and vaporizable materials having a boiling range below said isotropic pitch feed, and wherein said isotropic pitch feed rate, said water or steam addition, and velocity in said tubular reactor are sufficient to reduce coke deposition within the walls of said tubular reactor to less than 0.001"/hr.

16. The process of claim 15 wherein at least a majority by weight of said feed is cracked, dealkylated or vaporized to produce an overhead material having a lower boiling range than said feed and a liquid residue fraction equal to at least 40 wt % of said pitch feed and said liquid residue fraction contains at 70 to 90 wt % mesophase pitch.

17. The process of claim 15 wherein mesophase pitch product has a coking value of at least 88.

* * * * *